US005535769A

United States Patent [19]

Marcotullio et al.

[11] Patent Number: 5,535,769

[45] Date of Patent: Jul. 16, 1996

[54] PROCESS FOR MOVING HIGHLY VISCOUS PETROLEUM PRODUCTS

[75] Inventors: Armando Marcotullio, Milan; Alberto Di Lullo, Residenza Sirmione; Luigi Bertero, deceased, late of Milan, all of Italy, by Laura Tinucci

[73] Assignees: Eniricerche S.p.A.; AGIP S.p.A., both of Milan, Italy

[21] Appl. No.: 397,362

[22] Filed: Mar. 2, 1995

[30] Foreign Application Priority Data

Mar. 11, 1994 [IT] Italy ..... MI94A0452

[51] Int. Cl.[6] ..... F17D 1/17

[52] U.S. Cl. ..... 137/13; 252/312

[58] Field of Search ..... 137/13; 252/312

[56] References Cited

U.S. PATENT DOCUMENTS

| | | | |
|---|---|---|---|
| 4,915,708 | 4/1990 | Prevedello et al. . | |
| 5,364,960 | 11/1994 | Marcotullio et al. . | |
| 5,445,179 | 8/1995 | Di Lullo et al. | 137/13 |

*Primary Examiner*—Gerald A. Michalsky

*Attorney, Agent, or Firm*—Oblon, Spivak, McClelland, Maier & Neustadt

[57] ABSTRACT

Process for recovering and moving highly viscous petroleum products as aqueous dispersions in the presence of a sulphonate dispersing agent selected from the sulphonates of alkaline or earth-alkaline metals or ammonium of indene-cumarone sulphonate resins.

6 Claims, No Drawings

PROCESS FOR MOVING HIGHLY VISCOUS PETROLEUM PRODUCTS

The present invention relates to an improved process for moving and recovering highly viscous petroleum products through oil wells and pipes.

The moving of highly viscous petroleum products or residues, particularly those with an API degree of less than 15, through pipes, is difficult due to their high viscosity.

A method for improving the movement and recovery of these products consists in adding lighter hydrocarbons or crude products. This process has the disadvantage that these lighter fractions are not always available.

Another method for improving the fluidity of highly viscous products in pipes, consists in the installation of heating systems at frequent intervals along the pipe; in this way the heated crude or petroleum product has a lower viscosity thus facilitating its transportation. These heating systems can also be fed using part of the transported product as fuel with a consequent loss of 15–20% of the moved product.

Another method for moving heavy petroleum products or residues consists in pumping them through the pipe in the form of aqueous emulsions of the oil in water type, which are much more fluid than the crude product to be moved.

The oil in water emulsions, prepared by adding water and emulsifying agent under stirring to the oil to be moved, are then pumped into the pipe.

The emulsifying agent must produce a stable and fluid oil in water emulsion with a high percentage of oil.

To ensure that the process is advantageous, the emulsifying agent must be inexpensive and produce stable emulsions during the pumping stage.

The emulsifying agents proposed so far do not fully satisfy the above requisites.

For example, U.S. Pat. Nos. 4,246,920, 4,285,356, 4,265,264 and 4,249,554 describe emulsions which have an oil content of only 50%; in these conditions this means that half of the volume of the pipe is not available for transporting the oil.

On the other hand Canadian patents 1.108.205, 1.113.529 and 1.117.568 as well as U.S. Pat. No. 4,246,919 describe quite limited reductions in viscosity, in spite of the relatively low proportion of oil.

U.S. Pat. No. 4.770–199 discloses emulsifying agents consisting of complex mixtures of non-ionic alkoxylate surface-active agents with ethoxylate-propoxylate carboxylates. The non-ionic surface-active agent of the above mixture is obviously sensitive to temperature, and can therefore become insoluble in water under certain conditions of temperature. In addition, the above surface-active agents are very expensive and influence the cost of the process.

Finally EP-B-237.724 uses mixtures of ethoxylate carboxylates and ethoxylate sulphates as emulsifying agents, which are not easily available on the market and are quite expensive.

Several Italian patent applications claim a process for recovering and moving highly viscous petroleum derivatives by aqueous dispersions in the presence of suitable dispersing agents. In particular IT-A-Mi92 A 001712 describes the use of condensates with formaldehyde of naphthalenesulphonic acid, IT-A-Mi92 A 001643 describes the use of dispersing agents deriving from oxidative sulphonation with $SO_3$ of fuel-oil from steam cracking.

All these dispersing agents have various disadvantages. For example, the condensates of naphthalenesulphonic acid with formaldehyde require the use of a cancerogenous reagent such as formaldehyde, and the sulphonates of fuel-oil from steam cracking require the presence of plants capable of producing light olefins, in particular ethylene, via steam cracking of virgin naphtha or gas oil.

A process has now been found for moving highly viscous petroleum products which overcomes the above disadvantages in that it uses indene-cumarone sulphonate resins as dispersing agents, whose preparation (and use as dispersing agents for concentrated mixtures of carbon in water) is described in Italian patent application IT-A-MI93 A 000701 of Aug. 4, 1993. These sulphonates have the advantage of coming from coal-tar and gas-tar and do not therefore require production plants of ethylene via steam-cracking. Compared to condensates with formaldehyde, these dispersing agents have the advantage of not requiring the use of a toxic reagent such as formaldehyde. Finally these formulations are also effective in lower quantities than those of the former art.

In accordance with this, the present invention relates to a process for recovering and moving highly viscous petroleum products, the above highly viscous petroleum products being recovered and moved as aqueous dispersions, the water content being at least 15%, the above dispersions being formed by contact of the highly viscous petroleum products with an aqueous solution of a sulphonate dispersing agent, characterized in that the above sulphonate dispersing agent is selected from the sulphonates of alkaline or earth-alkaline metals or ammonium of indene-cumarone sulphonate resins.

Indene-cumarone resins are thermoplastic resins with a low molecular weight, usually less than 2,000.

The name indene-cumarone is not very appropriate as the quantity of cumarone is low, often less than 10% by weight of the total resin.

Indene-cumarone resins come from distillates of coal-tar and gas tar; they mainly consist of indene copolymerized with smaller quantities of methyl indenes, vinyl toluenes and traces of other monomers such as cumarone. Before being polymerized, the above resins are diluted with an inert solvent, particularly with an aromatic naphtha. The normal catalyst is sulphuric acid, even if $AlCl_3$ and $BF_3$ are just as efficient. The polymerization is rapid and at the end of the polymerization, the catalyst is removed with alkaline washings and the solvent removed by distillation. For further details concerning the properties and preparation of the above resins, see Encyclopedia of Polymers Science and Technology (Sec. Ediz.) Vol.4, pages 281–284.

The term "indene-cumarone sulphonate resins" refers to dispersing agents deriving from sulphonation with $SO_3$ of indene-cumarone resins according to what is described in IT-MI93 A 000701 of Aug. 4, 1993.

In accordance with what is disclosed in this Italian patent application, the process comprises the following steps:

- reaction with $SO_3$ of an indene-cumarone resin, in the presence of $SO_2$ as solvent, the weight ratio $SO_3$ resin being from 0.6 to 1.5 and the reaction temperature between 20° C. and 90° C.;
- removal of the $SO_2$ from the reaction environment;
- neutralization of the sulphonate product with an aqueous solution of the hydroxide of an alkaline or earth-alkaline metal or ammonium.

The reaction is carried out in a reactor suitable for withstanding pressures. The pressure which the reactor must tolerate basically depends on the vapour pressure of the sulphur dioxide at the reaction temperature.

$SO_2$ can be used for diluting either the indene-cumarone resin, or $SO_3$ or both. The ratio between $SO_2$ and reagents is not important; for economical reasons, it is preferable to use a weight ratio between $SO_2$ and $SO_3$ of between 1/1 and 10/1, preferably between 2/1 and 5/1.

The weight ratio between $SO_3$ and resin is between 0.6 and 1.5, preferably between 0.8 and 1.3. Lower ratios give not sufficiently sulphonated products which are consequently not very soluble in water, whereas higher ratios do not improve the quality of the product and create problems due to unreacted $SO_3$.

It is preferable to carry out the reaction in two subsequent steps, the first of which involves contact between the reagents and the second, the completion of the reaction.

During the period of time in which the reagents come into contact with each other, it is preferable to reduce the considerable heat produced by the sulphonation. It is therefore advisable to check that the temperature of the reactor during this phase does not exceed 30°–40° C. This can be effectively carried out by evaporating the $SO_2$ and/or externally cooling the reactor.

Once the contact phase of the reagents has terminated, the reaction is completed by heating the reaction mixture to a maximum temperature of 90° C., preferably to about 40°–80° C. Slightly higher temperatures do not give any advantage, whereas temperatures higher than 110°–120° C. can cause partial desulphonation of the sulphonate.

The reaction, also including the contact time of the reagents, is normally completed in a time of between 30 minutes and three hours.

It is also possible to carry out the reaction in a single step, provided that the above temperature limit (maximum 90° C.) are respected.

At the end of the above reaction, the $SO_2$ used as solvent is eliminated. This operation can be carried out using known techniques in various ways, for example by opening a sky-valve or at reduced pressure, preferably first by simple degassing and then at reduced pressure.

The sulphonate can be recovered using the conventional techniques, for example by adding an aqueous solution of a hydroxide of an alkaline or earth-alkaline metal or ammonium into the reactor, preferably of an alkaline metal, or even more preferably of sodium in which the sulphonate and salified dispersing agent is easily soluble.

The aqueous solution of the dispersing agent thus obtained can be used as such in the process of the present invention. Alternatively the water can be eliminated and the dry product used. In any case it is not necessary to carry out any purification operation.

When dry, the sulphonation reaction product consists for 70–90% by weight of sulphonate of the indene-cumarone resin, the complement to 100 consisting of inorganic salts, in particular sulphite and sulphate of the alkaline or earth-alkaline metal or ammonium.

The term highly viscous petroleum products, to be moved by means of the process of the present invention, means extremely viscous crude products, which cannot be extracted from the wells with the normal techniques, or petroleum residues of any origin, for example atmospheric or vacuum residues. In any case the above highly viscous petroleum products have an API gravity of less than 15° and a viscosity at 30° C. of more than 40,000 mPas.

To come back to the process of the present invention, the term "dispersion" is applied to a multiphase system, wherein one phase is continuous and at least one other is finely dispersed. The term "dispersing agent" refers to products or mixtures of products which cause the formation of a dispersion, or stabilize a dispersion, without greatly altering the interfacial tension between water and oil.

In the dispersion of the present invention, the continuous phase is water whereas the dispersed phase, more or less finely distributed, consists of particles, probably both solid and liquid, of heavy petroleum product.

The aqueous dispersions of the present invention are formed and stabilized by dispersing agents prepared in the above way.

The weight ratio between petroleum product and water can vary widely, for example between 90:10 and 10:90. It is preferably however, for obvious economical reasons, to use high contents of residue, even though these could have the disadvantage of being excessively viscous.

An excellent composition of the dispersion, depending on the type of product to be moved, comprises a water content of between 15 and 40% with respect to the total dispersion.

The quantity of dispersing agent also depends on the type of product to be moved; in any case the quantity of dispersing agent necessary for having a stable and fluid dispersion is between 0.05 and 2 5% preferably between 0.1 and 1.5%, said percentages referring to the quantity of dispersing agent with respect to the total quantity of water and petroleum product.

The aqueous dispersion of the heavy petroleum product can be carried out in the following way. First of all the salt, preferably sodium, of the sulphonate dispersing agent, is dissolved in water. The aqueous solution of the dispersing agent is then added to the petroleum product to be moved. The dispersion can be prepared at the oil campsite, for example, by stirring the two phases with a turbine or blade stirrer, or with centrifugal pumps, or with static mixers.

When oil wells containing heavy crude products which cannot be moved with the normal technologies, are being exploited, the crude product can be recovered with the above process.

In particular it is possible to inject the aqueous solution of the dispersing agent into the well so that it comes into contact with the oil at a greater or equal depth to that of the recovery pump.

In this case the mechanical mixing action produced by the pump will be sufficient to produce a fluid dispersion at the head of the well.

In this respect it is useful to point out that the good rheological properties, necessary for an effective recovery of the oil as an aqueous dispersion, do not depend either on the homogeneity of the dispersion or on the dimensions of the particles (solid or liquid) dispersed in the water.

In other words the process of the present invention does not require particular forms of mixing, and is not limited to particular dimensions of the dispersed particles. In fact the crude product can be moved and recovered even when the heavy dispersed oil is in the form of particles having macroscopic dimensions.

The dispersions of the present invention are stable for storage also for long periods of time (there is no sign in fact of irreversible separation of the phases even after several hundred hours).

It is therefore possible to store the above dispersion as desired in suitable tanks and send it to the pipe or ship at the appropriate moment.

This recovery and moving technique via aqueous dispersion has other advantages owing to the fact that inexpensive products are used as dispersing agents, which come from widely available raw materials.

Finally, as the sulphonates of the indene-cumarone resins, unlike the normal surface-active agents, do not lower the surface pressure of the water a great deal, the aqueous dispersions of the petroleum residue of the present invention does not require any anti-foam agent.

The following examples provide a better illustration of the present invention.

EXAMPLES

Examples 1–5 refer to the preparation of the sulphonate dispersing agent and are taken from IT-A-MI 93 A 000701 of Aug. 4, 1993.

A stainless steel, pressure-resistant reactor is used for the reaction, equipped with a stirrer and devices for heat exchange, temperature evaluation, inlet of the reagents and discharge of the reaction products.

In examples 1–3 an indene-cumarone resin is used abbreviated as B1/145 of Carbochimica S.p.A. The above resin has an average molecular weight (determined by HPLC/GPC) of about 2,000 g/mole and there are almost no products having a low molecular weight.

In examples 4–5 a resin abbreviated as B1/95 of Carbochimica S.p.A. is used. The above resin has an average molecular weight (again determined by HPLC/GPC) of about 1000 g/mole and also in this case there are almost no products with a low molecular weight.

Example 1

213.9 grams of indene-cumarone resin B1/145, are charged into the pressure vessel, which is cleansed with nitrogen and 810 grams of liquid sulphur dioxide are then added.

213.6 grams of liquid sulfur trioxide are fed, in about 26 minutes, into the stirred pressure vessel. In this period of time, the increase of temperature, which goes from the initial 15° C. up to a maximum value of 30° C., is controlled by water circulation in the coil of the pressure vessel.

The pressure vessel is then heated, in about 29 minutes, to 70° C. and the temperature is maintained between 70° and 74 ° C. for about 30 minutes.

At the end the stirring is interrupted and the sulphur dioxide is discharged by lowering the pressure to environmental values. The pressure vessel is then cleansed with nitrogen to remove the final traces of sulphur dioxide and subsequently kept under vacuum for 30 minutes. Sodium hydroxide is then added until the pH of the resulting solution reaches about 8.5. The sodium hydroxide added amounts to 93.7 grams (474 grams of an aqueous solution at 19.77% by weight).

The pressure vessel is washed with water and 2885 grams of aqueous solution are obtained which contain 317.4 grams of dry residue consisting of 39.7% of $Na_2SO_4$+$Na_2SO_3$ and 60.3% of sulphonate.

Example 2

The same procedure is carried out as in example 1, starting from 236 grams of indene-cumarone resin B1/145, 814 grams of sulphur dioxide and 188 grams of sulphur trioxide, with the temperature increasing, during the addition of $SO_3$ in 18 minutes, from 13 to a maximum value of 36° C., a time necessary for heating to about 80° C. of 27 minutes and a final phase at 80°–85° C. of 30 minutes. The sulphur dioxide is degassed in 35 minutes, the pressure vessel is cleansed with nitrogen and is kept under vacuum for 30 minutes. The solution is then neutralized with 79.5 grams of NaOH (402 grams of an aqueous solution of NaOH at 19.77%) by weight and washing with water is carried out.

2452 grams of an aqueous solution are thus obtained (final pH=9.27), which contains 279.7 grams of dry residue consisting of 23.8% of $Na_2SO_4$+$Na_2SO_3$ and 76.2% of sulphonate.

Example 3

The same procedure is carried out as in example 1, starting from 160 grams of indene-cumarone resin B1/145, 800 grams of sulphur dioxide and 208.5 grams of sulfur trioxide, with the temperature increasing, during the addition of $SO_3$ in 25 minutes, from 19 to a maximum value of 30° C., a time necessary for heating to about 90° C. of 27 minutes and a final phase at 90°–95° C. of 25 minutes. The solution is then neutralized with 96.9 grams of NaOH (629.4 grams of an aqueous solution of NaOH at 15.4%) by weight and washing with water is carried out.

2149 grams of an aqueous solution are thus obtained (final pH=9.20), which contains 468 grams of dry residue consisting of 27.4% of $Na_2SO_4$+$Na_2SO_3$ and 72.6% of sulphonate.

Example 4

The same procedure is carried out as in example 1, starting from 217.3 grams of indene-cumarone resin B1/85, 810 grams of sulphur dioxide and 217.3 grams of sulphur trioxide, with the temperature increasing, during the addition of $SO_3$ in 29 minutes, from 15 to a maximum value of 35° C., a time necessary for heating to about 40° C. of 10 minutes and a final phase at 40°–42° C. of 30 minutes. The $SO_2$ is degassed in 15 minutes, the reactor is cleansed with nitrogen in 35 minutes and is kept under vacuum for 30 minutes to remove all the $SO_2$. The solution is then neutralized with 116.8 grams of NaOH (611.8 grams of an aqueous solution of NaOH at 19.09%) by weight and washing with water is carried out.

2477 grams of an aqueous solution are thus obtained (final pH=8.78), which contains 427.4 grams of solid consisting of 18.8% of $Na_2SO_4$+$Na_2SO_3$ and 81.2% of sulphonate.

Example 5

The same procedure is carried out as in example 1, starting from 138.8 grams of indene-cumarone resin B1/85, 805 grams of sulphur dioxide and 180.2 grams of sulphur trioxide, with the temperature increasing, during the addition of $SO_3$ in 40 minutes, from 15 to a maximum value of 42° C., a time necessary for heating to about 80° C. of 20 minutes and a final phase at about 80° C. of about 30 minutes. The $SO_2$ is degassed in 30 minutes, the reactor is cleansed with nitrogen and is kept at reduced pressure for 30 minutes. The solution is then neutralized with 91.3 grams of NaOH (592.2 grams of an aqueous solution of NaOH at 15.4%) by weight and washing with water is carried out.

2072 grams of an aqueous solution are thus obtained (final pH=9.27), which contains 379.6 grams of dry residue consisting of 27.5% of $Na_2SO_4$+$Na_2SO_3$ and 72.5% of sulphonate.

Example 6

The dispersing agents prepared according to the procedure described in examples 1–5 are used for moving highly viscous petroleum products. The data of these tests are shown in table 1.

The crude product "Olio Gela" with a high content of aromatics and having the following characteristics, is used as petroleum product:

viscosity at 30° C.: 60,000–100,000 mPa.s;

API degree: 7–10.

The abbreviation OG 22 refers to the above crude product with water-cut=13–16% whereas the abbreviation OG92 is the same crude product with water-cut <1%.

The tests were carried out using both distilled water (abbreviated FW) and well water, having a concentration of $Na^+$ ions=2.43% $Ca^{++}$ ions=0.51%, $K^+$ ions=0.160% and $Mg^{++}$ ions=0.070% by weight.

The ratio crude product/water was fixed at 70/30 weight/weight, whereas the concentration of dispersing agent was varied.

The dispersion was carried out by adding the petroleum product, at a temperature of about 20° C., to an aqueous solution of dispersing agent. The stirring was initially manual and subsequently carried out by turbine of the Ultraturrax type at about 5000 rpm for 10–60 seconds.

The aqueous dispersions thus prepared were left to rest at room temperature (about 20°–22° C.) periodically controlling that the phases did not irreversibly separate. The data of table 1 show the rheological properties of the above dispersions after 240 hours from their preparation.

To carry out the above rheological measurements, a Haake RV12 rheometer was used with bob-cup geometry (model MVI P, bob radius 20.04 mm, cup radius 21.00 mm, bob height 60 mm) and a roughened bob to reduce any possible slip phenomena. The bottom of the bob is pulled back so that, when the bob is introduced into the dispersion, an air bubble is withheld, which is capable of minimizing the edge effects. All the measurements were carried out at 20° C.

Table 1 shows the viscosity at $10sec^{-1}$ and at $50sec^{-1}$ and the yield stress. The latter, or minimum stress necessary for making a mass of fluidified crude product move, was obtained by extrapolations. The method used is based on the Casson model, which consists in plotting on a graph the square root of the stress against the square root of the shear rate and extrapolating the curve obtained to zero in a straight line. The square of the value of the intercept at shear rate zero provides the yield stress value required. The viscosities are in mPa.s, the Yield stress in Pa, and the concentration of the dispersing agent in % weight of the total dispersion.

TABLE 1

| Add Ex. | Oil Type | Water Type | Conc % w | $V.10s^{-1}$ mPa.s | $V.100s^{-1}$ mPa.s | Yield st. Pa |
|---|---|---|---|---|---|---|
| 2 | OG22 | RW | 0.5 | 150 | 110 | <0.5 |
| 2 | OG22 | FW | 0.5 | 80 | 65 | <0.5 |
| 3 | OG22 | RW | 0.5 | 290 | 120 | <0.9 |
| 3 | OG92 | FW | 0.1 | 130 | 70 | <0.5 |
| 3 | OG22 | FW | 0.5 | 150 | 100 | <0.05 |

The data of table 1 show the drastic decrease in viscosity of the above dispersions with additives compared to the viscosity of the starting oil. In addition it can be seen how it is possible with distilled water and in the presence of a crude product with a high water-cut (OG22) content, to obtain very interesting viscosities in the presence of extremely reduced quantities of dispersing agent (0.1% by weight of the total), lower than those normally used in the prior art (about 0.3–1%).

We claim:

1. Process for recovering and moving highly viscous petroleum products, the above highly viscous petroleum products being recovered and moved as aqueous dispersions, the water content being at least 15%, the above dispersions being formed by contact of the highly viscous petroleum products with an aqueous solution of a sulphonate dispersing agent, characterized in that the above sulphonate dispersing agent is selected from the sulphonates of alkaline or earth-alkaline metals or ammonium of indene-cumarone sulphonate resins.

2. Process according to claim 1, characterized in that the water content of the dispersion is between 15 and 40% by weight with respect to the total of the dispersion.

3. Process according to claim 1, characterized in that the highly viscous petroleum product has a gravity of less than API 15°.

4. Process according to claim 1, wherein the quantity of dispersing agent is between 0.05 and 2.5% with respect to the total weight of the dispersion.

5. Process according to claim 4, wherein the quantity of dispersing agent is between 0.1 and 1.5% with respect to the total weight of the dispersion.

6. Pumpable aqueous dispersion of a highly viscous petroleum product in water, which comprises a very viscous petroleum product in a quantity of between 60% and 85% by weight, a sulphonate dispersing agent selected from the salts of alkaline or earth-alkaline metals or ammonium of indene-cumarone sulphonate resins in a quantity of between 0.05 and 2.5% by weight, the complement to 100 being water.

* * * * *